US007234502B2

(12) United States Patent
O'Malley

(10) Patent No.: US 7,234,502 B2
(45) Date of Patent: Jun. 26, 2007

(54) OVERHEAD DOOR APPARATUS WITH ENCLOSED COUNTERBALANCE MECHANISM

(76) Inventor: James J. O'Malley, 4033 Berry Ave., Drexel Hill, PA (US) 19026

( * ) Notice: Subject to any disclaimer, the term of this patent is extended or adjusted under 35 U.S.C. 154(b) by 304 days.

(21) Appl. No.: 10/963,339

(22) Filed: Oct. 12, 2004

(65) Prior Publication Data

US 2005/0139332 A1 Jun. 30, 2005

Related U.S. Application Data

(63) Continuation-in-part of application No. 10/746,903, filed on Dec. 26, 2003, now abandoned.

(51) Int. Cl.
*E05F 15/00* (2006.01)

(52) U.S. Cl. ..... 160/191; 49/200

(58) Field of Classification Search ..... 160/188, 160/191, 192, 193; 49/358, 200, 197, 199
See application file for complete search history.

(56) References Cited

U.S. PATENT DOCUMENTS

| | | | | |
|---|---|---|---|---|
| 1,059,981 | A | | 4/1913 | Cross |
| 1,508,886 | A | | 9/1924 | Dautrick et al. |
| 1,530,762 | A | | 3/1925 | Dautrick |
| 1,661,719 | A | | 3/1928 | Edwards |
| 1,724,995 | A | | 8/1929 | Dautrick |
| 2,015,402 | A | | 9/1935 | Johanson |
| 2,064,470 | A | | 12/1936 | Heckman |
| 2,253,170 | A | | 8/1941 | Dunham |
| 2,291,583 | A | | 7/1942 | Rowe |
| 2,338,205 | A | * | 1/1944 | Rowe ..... 160/191 |
| 2,481,037 | A | | 9/1949 | Pringle |
| 2,568,808 | A | | 9/1951 | Johanson |
| 2,675,211 | A | | 4/1954 | Regoord |
| 2,676,294 | A | | 4/1954 | Wilcox |
| 2,882,044 | A | | 4/1959 | Ginte |
| 3,359,559 | A | | 12/1967 | Guinn |
| 3,555,748 | A | | 1/1971 | Herman |
| 3,584,414 | A | | 6/1971 | Bahnsen |
| 3,747,274 | A | | 7/1973 | Moorman et al. |
| 3,774,341 | A | | 11/1973 | Schoonover et al. |
| 4,003,552 | A | | 1/1977 | Sobolewski |
| 4,074,915 | A | | 2/1978 | Saffer |
| 4,248,016 | A | | 2/1981 | Pecchioni |
| 4,468,904 | A | | 9/1984 | O'Malley |
| 4,908,987 | A | | 3/1990 | Dickson et al. |
| 5,036,899 | A | | 8/1991 | Mullet |
| 5,103,890 | A | | 4/1992 | Cloutier |
| 5,280,818 | A | * | 1/1994 | Ubelhart ..... 160/265 |
| 5,404,927 | A | | 4/1995 | Bailey |
| 5,419,010 | A | | 5/1995 | Mullet |
| 5,495,640 | A | | 3/1996 | Mullet et al. |
| 5,560,658 | A | | 10/1996 | Coolman et al. |
| 5,577,544 | A | | 11/1996 | Carper et al. |
| 5,615,723 | A | | 4/1997 | Carper |
| 5,632,063 | A | | 5/1997 | Carper et al. |
| 5,899,401 | A | | 5/1999 | Reimann et al. |
| 5,964,268 | A | | 10/1999 | Carper et al. |
| 6,042,158 | A | | 3/2000 | Horn |
| 6,112,464 | A | | 9/2000 | Grisham et al. |

(Continued)

*Primary Examiner*—Blair M. Johnson
(74) *Attorney, Agent, or Firm*—Design IP

(57) ABSTRACT

An overhead garage door with a counterbalance mechanism incorporated into a pocket or hollow section formed in the door.

14 Claims, 8 Drawing Sheets

U.S. PATENT DOCUMENTS

| | | | | |
|---|---|---|---|---|
| 6,134,835 | A | 10/2000 | Krupke et al. | |
| 6,263,948 | B1 | 7/2001 | Whitley | |
| 6,289,966 | B1 | 9/2001 | Hoermann | |
| 6,505,381 | B1 | 1/2003 | Thomson et al. | |
| 6,561,256 | B2 | 5/2003 | Mullet | |
| 6,568,454 | B1 | 5/2003 | Mullet et al. | |
| 6,588,482 | B2 | 7/2003 | Wright | |
| 6,626,226 | B2 * | 9/2003 | Whitley | 160/236 |
| 2005/0139332 | A1 * | 6/2005 | O'Malley | 160/191 |

* cited by examiner

OVERHEAD DOOR APPARATUS WITH ENCLOSED COUNTERBALANCE MECHANISM

CROSS REFERENCE TO RELATED APPLICATIONS

This Application is a Continuation-in-Part of U.S. patent application Ser. No. 10/746,903 filed Dec. 26, 2003 now abandoned.

FIELD OF THE INVENTION

The subject invention relates generally to multi-panel doors, such as used as a residential garage door, commercial garage doors, large industrial doors and the like. In particular the present invention relates to such doors which have been reengineered to have a compartment within a door section or panel which houses a counterbalance mechanism responsible for counteracting the effect of gravity on the door as it moves from a closed to an open position and from an open to a closed position.

BACKGROUND OF THE INVENTION

Overhead doors are not new and are seen frequently in buildings such as homes, automotive shops, barns, aircraft and blimp hangars, commercial warehouses, portable military field structures, and the like. A wide variety of doors are currently used in industrial and other settings. For example, one type of movable door consists of a series of generally horizontal panels disposed one on top of the other with each panel hinged to the panel above. Stemmed rollers are disposed on opposed lateral edges adjacent a bottom and top location of each door panel. Such sectional doors are typically movable between a closed or blocking position and an open or stored position relative to a doorway. For this purpose, guide tracks having a generally "C" shaped cross-section are provided on either side of the doorway for receiving the rollers disposed on the adjacent edges of each of the panels. Each track has a substantially vertical portion disposed adjacent and parallel to the doorway opening, a substantially horizontal portion disposed above and behind the doorway generally perpendicular to the doorway opening, and a connecting curved portion. A track is positioned on either side of the doorway providing a continuous guide track for receiving the stemmed rollers of the adjacent panel sections. In this construction, the door is substantially horizontal when in the open or stored position. Another type of movable door is a vertically storable door which moves in a continuous generally vertical plane between the closed and open (stored) positions along substantially straight and vertical guide tracks disposed from floor level of the door opening to a location above the doorway opening. The lifting force needed to counterbalance the door is recognized to vary so that different types of lifting assist devices are used to provide a statically balanced overhead door i.e. a door that will maintain a position assigned to it by an operator (user). The position can be closed, open or any location in between.

One type of garage door operating mechanism is the so called torsion spring control system. The torsion spring control system uses a shaft around which are disposed control springs to provide the counterbalance for the door. This type of mechanism avoids the use of extension springs but the torsion spring is exposed and can provide a source of injury if repairs or adjustments are attempted by one not skilled in working with such devices.

Another type of counterbalancing mechanism comprises horizontally extendable springs disposed above and generally parallel to the horizontal portion of the guide tracks for counteracting the effect of gravity on the door as it moves between a closed and an open (stored) position or from an open to a closed position. Such counterbalance devices typically include a cable system with a pair of cables attached to the opposite edges of the door with springs connected to each of the cables. In the door open or stored position the spring is not extended, eg. Relaxed or compressed. When the door moves from the stored position, the spring extends or is streched providing a force which counteracts the weight of the door. In this way, the spring controls the descent of the door as it moves toward the closed position. Conversely, when the door is raised from the (doorway-blocking) closed position, the contracting spring provides a lifting force which makes the door easier to raise. Unfortunately, such mechanisms are complicated to assemble, they lack aesthetic appeal and expose the user to potential injury if the spring or cable breaks.

It would therefore, be desirable to house counterbalancing mechanisms within the door itself, thereby providing a more user friendly installation and an aesthetically pleasing door assembly with internal components that are unexposed reducing the potential of injury to a user.

U.S. Pat. No. 6,505,381, teaches using pulleys and a cable in conjunction with a hinge system for deploying panels or other structures from a satellite or spacecraft. The hinge system is placed within a telescoping housing in the deployed position.

U.S. Pat. No. 5,560,658, teaches an overhead bi-fold door with the cable and pulley system within the frame of the door to unlatch the door.

U.S. Pat. No. 6,042,158, discloses a cable actuated locking system inside the body of an overhead door.

U.S. Pat. Nos. 3,774,341 and 4,248,016, teach cable and spring operating systems for overhead doors that are positioned in the frame around the door.

U.S. Pat. No. 1,530,762, teaches a dual race cable drum having an inner race that spools a cable connected to a tensioning member and a larger outer race with separate cables connected to the door bottom.

U.S. Pat. No. 6,134,835 teaches a worm-gear drive winding mechanism to effect the winding of torsion springs on an up-ward acting door. It is supported by brackets attached to the wall above the door, with cables that depend from the counterbalance system and connect to the lower side edges of the door.

U.S. Pat. Nos. 2,291,583; 5,404,927 5,495,640; 6,112,464; 6,263,948 and 6,588,482 teach cable attachment brackets on the bottom edge of an upward acting door to receive the counterbalance cable which lifts the door.

U.S. Pat. No. 6,561,256, teaches opposed independent extension springs and lift cables of an overhead door to synchronize by means of an interconnected drive tube mounted above the door.

U.S. Pat. No. 3,747,274 teaches a cable and spring actuated locking system mounted on a vertically disposed door.

U.S. Pat. No. 5,103,890 teaches an overhead door system to be counterweighted with cables that depend from differential cable drums on a shaft mounted above the door with separate cable drums and cables that depend for attachment on the bottom edge of the door.

U.S. Pat. No. 6,289,966 teaches a door with a counterweight unit mounted on the uppermost door leaf.

U.S. Pat. No. 6,568,454 teaches the counterbalance system mounted above an overhead door to be rotated by an operator motor assembly.

U.S. Pat. No. 1,724,995 teaches an overhead door to be counterbalanced by the resilient action of a torsion spring upon a shaft with flanged pulleys spooling steel tape attached to the bottom of the door.

U.S. Pat. No. 1,059,981 teaches a bi-fold warehouse door to lift by chains secured to the bottom of the door with separated lateral bearing studs.

U.S. Pat. Nos. 1,724,995 and 2,882,044, teach operating the torsion shaft of a counterbalance assembly above a door to be rotated by an operator motor.

U.S. Pat. No. 1,661,719 teaches an endless chain driven by a motor carry to a trolley or carriage which is movable to the front and rear of a T-irons runway above an overhead door with the carriage linked to the door, whereby the door may be pulled or pushed effecting the opening and closing of the door.

U.S. Pat. No. 2,253,170 teaches an electric motor to turn a drive screw which carries a nut affixed to a carriage that travels forward and backward on a channel above a garage door and opens and closes the door.

The above two patents do not teach a linear drive motor mechanism to be significantly shorter in length as the distance the extension spring extends or retracts is far less in proportion to the full length of travel of the door. The length of a typical chain or screw drive opener mounted above a door is 10'. The length of the extension of the spring on the same door would be 3.3' or approximately ⅓ the distance of travel. Further mechanical control of speed and force will be recognized as well.

U.S. Pat. Nos. 2,015,402; 2,568,808 and U.S. Pat. No. 5,036,899 teach a lateral shaft mounted on the top section of an overhead door to rotate with tension applied to the shaft by torsion spring means and pinions outboard of the lateral edges of the door which engage racks along the door tracks effecting the counterbalance of the weight of the door with rotation of the lateral shaft by a motor carried on the door.

U.S. Pat. No. 2,676,294 teaches opposed independent extension springs and lift chains of an overhead door to synchronized by combining sprockets on a shaft, above the door, to unify the lift chains and further permit rotation of the shaft directly by a motor assembly.

U.S. Pat. No. 4,468,904 teaches functionally connected torsion springs to counterbalance a telescoping tower.

U.S. Pat. No. 5,577,544 teaches a cable reeling device to affect the extension of a spring parallel with the horizontal track of an overhead door. An extension spring containment tube which surrounds the entire periphery of an extension spring over its operational length is also disclosed.

U.S. Pat. No. 5,632,063 teaches a worm drive ring shaped gear winding mechanism to affect the winding of torsion springs above an overhead door.

U.S. Pat. No. 1,508,886 teaches providing garage door units which may be assembled, in part, at a factory and shipped to a garage to be easily and quickly installed, that affords a safe and durable closure for the garage.

None of the prior art teach or suggest a garage door having a novel or conventional counterbalance mechanism enclosed within a panel of the door nor cables and pulley systems within a panel of the door with the cable exiting the door to a fixed location outside of the door.

SUMMARY OF THE INVENTION

The present invention pertains to an overhead door system of the type having a multi-panel door with at least one hollow or enclosed door section; the door being moveable between a closed vertical position and an open generally horizontal position relative to a doorway; and a counterbalance mechanism housed within the hollow or enclosed section of the door to facilitate the movement of the door between open and closed positions. The counterbalance mechanism within the hollow door section replaces conventional torsion spring counterbalance mechanisms associated with overhead type doors which are mounted outside of the door either above the door frame, or extension spring mechanism with each extension spring mounted parallel to each of the guide rails.

In its broadest aspect the present invention is an overhead door within least one hollow door section containing and enclosing a counterbalance mechanism therein for counteracting the effect of gravity on the door and for controlling the movement and positioning of the door between the open and closed positions.

In one embodiment of the present invention is a vertically moveable door having at least one hollow door section containing a counterbalance mechanism therein, the counterbalance mechanism having a torsion means, cable drums fixed to each end of the torsion spring means, a cable spooled around each drum, and a plurality of direction transfer pulleys, wherein the cable passes around direction transfer pulleys out of hollow door section to a fixed point above the door.

In another embodiment of the present invention, an overhead door is positioned in fixed tracks disposed on either side of the door, with the door having at least one hollow door section containing a counterbalance mechanism therein, the counterbalance mechanism including extension spring means, at least two pulleys one of which is fixed to one end of the extension spring, cables attached to fixed points within the hollow door panel and running through the pulleys and exiting the sides of the hollow door section to fixed points above and adjacent to either side of the door.

Therefore a goal of the present invention is to provide an overhead door wherein the counterbalance mechanism is enclosed within the door itself.

Another goal of the present invention is to provide an overhead door with a counterbalance assembly within an enclosed portion of the door itself without modifying existing track configurations for mounting the door.

DETAILED DESCRIPTION OF THE INVENTION

Figure 1:
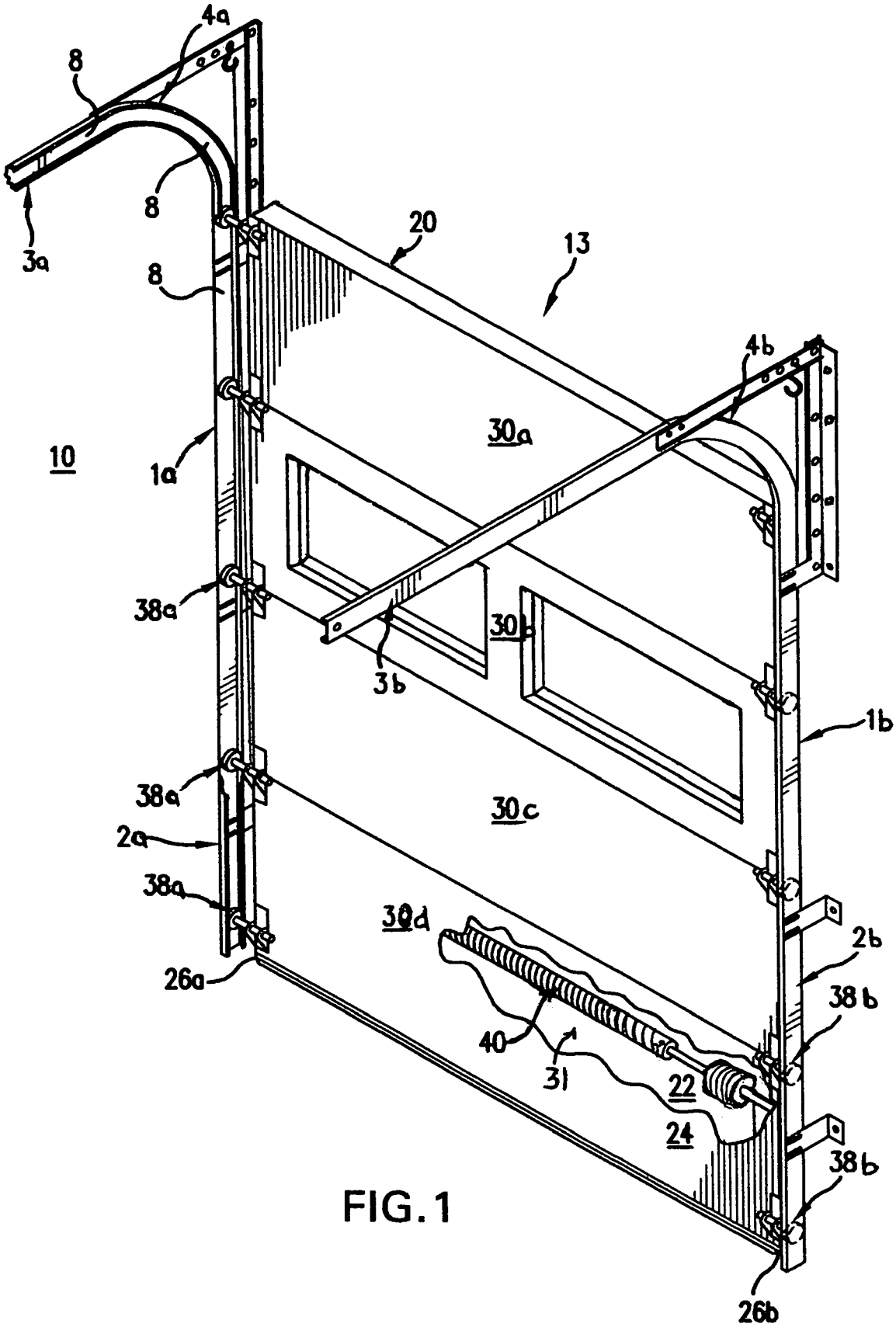
FIG. 1 is a rear perspective view of an overhead door assembly according to the present invention with the door in a closed position, portions of the door cutaway to reveal a counterbalance mechanism according to the invention contained therein.

Referring to FIG. 1, an overhead door according to the present invention is shown generally by the numeral 10. FIG. 1 depicts a residential or commercial overhead garage door for the purposes of illustration. The overhead door assembly 10 is an integral unit and includes a vertically moveable door 20 consisting of door sections 30*a*, 30*b*, 30*c* and 30*d* with at least one section (eg. 30*d*) covered with a panel, panel or panel cover 24 to create a hollow door section 31 for enclosing therein the counterbalance mechanism 40 as described in greater detail below. While door 20 is described in relation to one cover or panel 24, each door section 30*a*, 30*b*, 30*c* and 30*d* is fitted with a like panel to create a fully hollow door.

Door 20 is moveable relative to a doorway, indicated by arrow 13, between a closed or blocking position and an open or stored position. In the embodiment illustrated in FIG. 1, door 20 consists of four door sections 30*a*, 30*b*, 30*c*, 30*d* in series, placed one on top of another, and hinged together as is known in the art. However, hollow door section 31 is created in the bottommost panel 30*d* by including the cover 24. Hollow door section 31, is created by front panel 22, rear panel 24, and opposed lateral edges or side stiles or stiffeners 26*a*, 26*b* of bottommost panel 30*d*. A pair of side-mounted guiding elements or lateral end members in the form of rollers 38*a*, 38*b* are positioned perpendicular to lateral edges 26*a*, 26*b* of door section 30*d* for rolling engagement within a pair of guide tracks 1*a*, 1*b* having a generally "C" shaped cross-section mounted on each side of the doorway 13. Identical roller elements are positioned on either side of each of the door panels 30*a*, 30*b*, and 30*c*. Door panels 30*a*, 30*b*, 30*c*, 30*d* may be flat or embossed or contain windows as shown in FIG. 1 in relation to the panel 30*b*, second from the top of door 20. In the embodiment of FIG. 1, each guide track 1*a*, 1*b* includes a first segment 2*a*, 2*b* which extends substantially vertically parallel to the sides of the doorway 13. A second overhead or horizontal 3*a*, 3*b* of tracks 1*a*, 1*b* extends substantially perpendicular to the doorway 13, and curved segments 4*a*, 4*b* connect the vertical and horizontal portions of tracks 1*a*, 1*b* to form continuous paths for the door rollers. Each guide track 1*a*, 1*b* receives guiding members or rollers 38*a*, 38*b* of door 20, which are positioned within and adapted to run along the entire length of guide tracks 1*a*, 1*b* as is known in the art.

Although door 20 described and illustrated in FIG. 1 consists of a plurality of hingedly attached door sections 30*a*, 30*b*, 30*c*, 30*d*, it will be readily appreciated by those skilled in the art that door 20 may take other forms without departing from the scope or spirit of the present invention. The hollow door section 31 housing the counterbalance mechanism may contain insulation disposed around the mechanism. Door 20 may also be a single insulated or non-insulated hollow structure (i.e., a non-hinged door). It will also be appreciated that the guiding members or rollers 38*a*, 38*b* for door 20 may take other forms including, for example, pins with rounded heads which are received by guide tracks 1*a*, 1*b*. Alternatively, lateral edges 26*a*, 26*b* of door sections 30*a*, 30*b*, 30*c*, 30*d* could form the guiding members by having a boss or other structural member directly received in the guide tracks 1*a*, 1*b*. In addition, the guide tracks 1*a*, 1*b* may alternatively be completely straight and vertical, as opposed to curved. In this way, door 20 would be disposed vertically in both the closed and open positions facilitating the use of a one-piece door.

Figure 2:
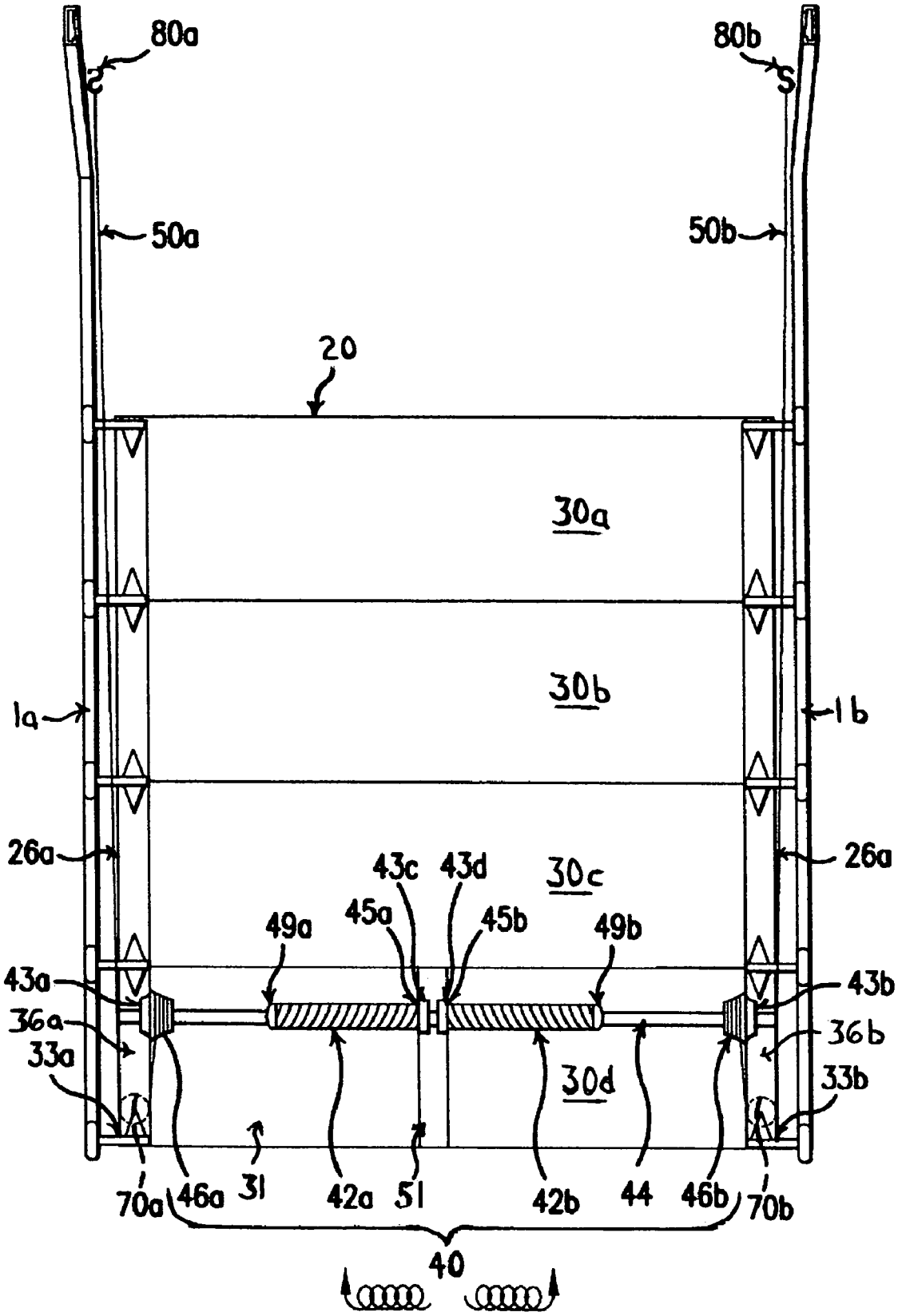
FIG. 2 is a rear elevational view of the overhead door assembly of FIG. 1 with a bottom inside panel cover removed to show a torsion spring counterbalance mechanism according to the present invention.

Referring to FIG. 2, counterbalance mechanism 40 is disposed on the inside of lowermost panel 30*d* of door 20 for controlling movement of or counteracting the effects of gravity as door 20 moves between an open (not shown) and closed position and to overcome the weight of the door as it moves between the closed and open positions. Counterbalance mechanism 40 may be constructed in numerous ways and housed inside of the door itself by providing a cover panel 24 (FIG. 1) spaced apart from the inside of face 22 of lowermost panel 30*d*. In a first embodiment, counterbalance mechanism 40 consists of a pair of torsion springs 42*a*, 42*b* which are disposed around support shaft 44. A pair of spaced-apart cable drums 46*a*, 46*b* are mounted at opposite ends of support shaft 44, and a pair of cables 50*a*, 50*b* have one end fixed to drums 46*a* and 46*b* respectively and on an opposite end are fixed to the structure supporting the rails 1*a*, 1*b* at a location above the door 20 by hooks 80*a* and 80*b* so that cables 50*a* and 50*b* are generally vertical and parallel to vertical portions 2*a* and 2*b* of tracks 1*a*, 1*b* (FIG. 1). Support shaft 44 is rotatably mounted on door 20 at the opposite ends by shaft support bearings 43*a*, 43*b*. Springs 42*a*, 42*b* may be helical torsion springs or other suitable springs or tensioning devices known to those skilled in the art. One end of each spring 42*a*, 42*b* is positioned on shaft 44 by adjustable positioning cones 49*a*, 49*b*. The opposite ends of each spring 42*a*, 42*b* are positioned by stationary mounting cones 45*a*, 45*b* which also support position or hold shaft bearings 43*c*, 43*d*. The stationary mounting cones 45*a*, 45*b* can be attached or to a support or stiffener 51 located in the center of panel 30*d* of door 20. As may be appreciated a single torsion spring 142 (FIG. 3) may be substituted for the pair of springs 42*a*, 42*b* of FIG. 2. Support shaft 44 is rotatably mounted within hollow door section 31 of panel 30*d*, with the axis of rotation of cable drums 46*a*, 46*b* substantially perpendicular to the opposed lateral edges 26*a*, 26*b* of hollow door section 31 of panel 30*d*. A length of cable 50*a*, 50*b* is fastened at one end to its respective cable drum 46*a*, 46*b* and the free end wound around the respective drum. The free ends of cable 50*a*, 50*b* then extend downward to the lowermost corners of hollow door section 31 where they pass through bottom pulley fixtures 70*a*, 70*b* and directed out of door 20 through apertures 33*a*, 33*b* in door stiles or stiffeners 36*a* and 36*b* and upward to fixed points 80*a*, 80*b* above door 20. Although flexible elements 50*a*, 50*b* are described herein as cables, it will be appreciated by those skilled in the art that cables 50*a*, 50*b* can be replaced by, for example, cords, ropes, belts, chains, and the like.

Counterbalance mechanism 40 of FIG. 2 not only controls the descent of the door 20 as it moves downwardly from the open position, but it also makes the door 20 easier to raise from the closed position. For example, when the door 20 moves towards the closed position, the support shaft 44 rotates about its axis, the cables 50*a*, 50*b* progressively unwind from the cable drums 46*a*, 46*b*, and springs 42*a*, 42*b* become increasingly tensioned by compression of. This tensioning of springs 42*a*, 42*b*, in turn, causes cables 50*a*,

50*b* to exert a force on door 20 which partially counteracts its weight. In this way, counterbalance mechanism 40 controls the descent of door 20 as it is moved from the open to the closed position. Conversely, when door 20 is lifted from the closed position, the energy stored in tensioned springs 42*a*, 42*b* provides a force which makes it easier to elevate door 20. Springs 42*a*, 42*b*, unwind or are counter tensioned by counter-rotation of shaft 44. In any position, tension is continuously maintained in cables 50*a*, 50*b* as door 20 moves between the open and closed positions or vice versa. If, cables 50*a*, 50*b* were to fail or become too slack, counterbalance mechanism 40 would no longer be able to aid in controlling the upward or downward movement of door 20.

Figure 3:
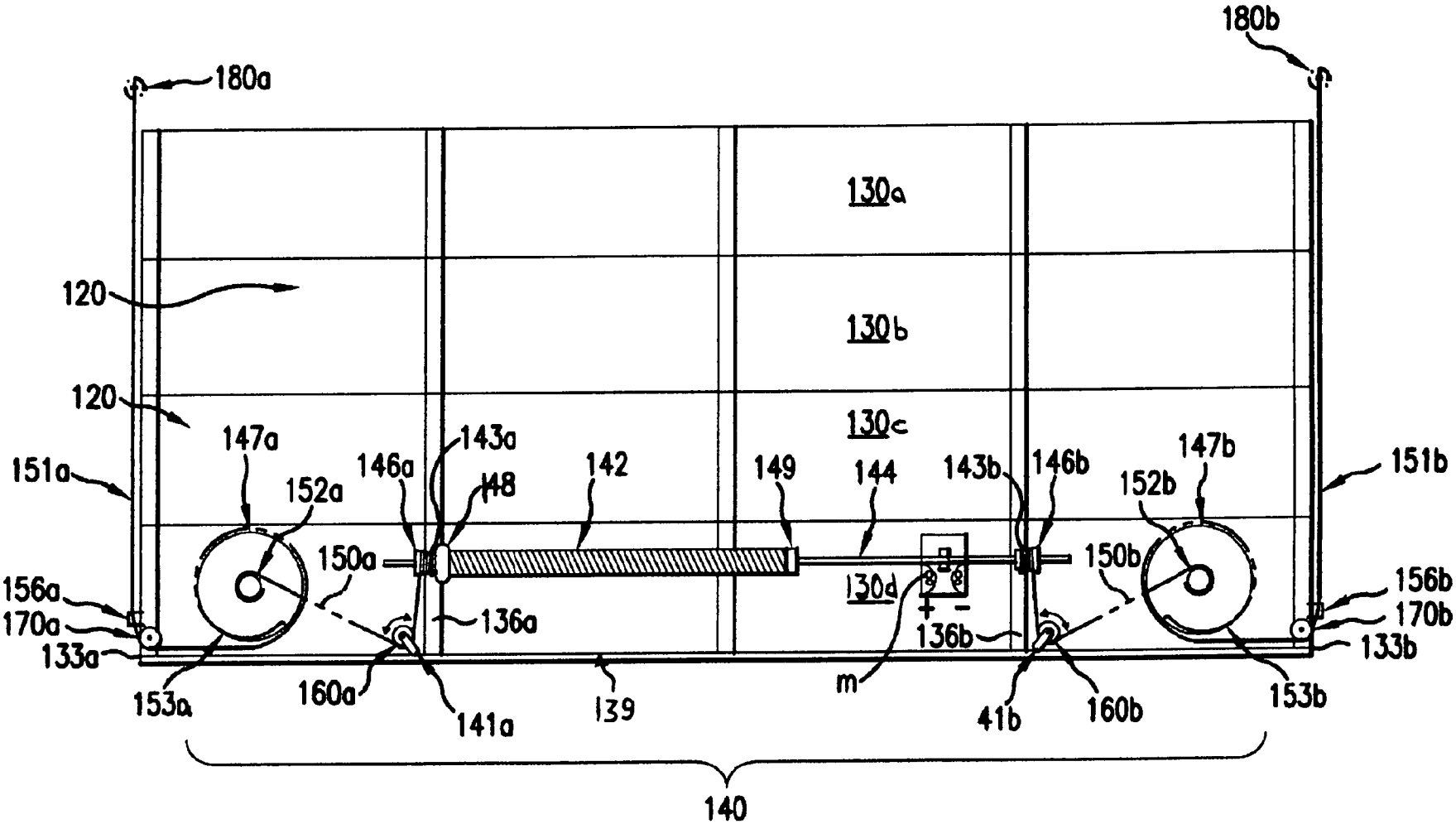
FIG. 3 is a rear elevational view of alternate embodiment of a counterbalance mechanism for an overhead door assembly according to the present invention.

In the embodiment shown in FIG. 3 the counterbalance mechanism 140 includes dual race cable pulleys or drums 147*a*, 147*b* to overcome the limitation that the diameter of each cable drum 146*a*, 146*b* is limited to that which will fit within the thickness of hollow door section 130*d*. Accordingly, cable drums 146*a*, 146*b* will have a relatively limited cable storage capacity. When the desired mechanical advantage can not be achieved with the capacity of the respective cable drums 146*a*, 146*b* (e.g. for a fully vertical left door) the addition of an intermediate cable spooling apparatus may be employed to resolve this problem as described in detail below.

As shown in FIG. 3, counterbalance mechanism 140 helps the user to open and close door 120. In this embodiment, counterbalance mechanism 140 includes a single torsion spring 142 which is rotatably mounted around a support shaft 144. Support shaft 144 is rotatably mounted to door 120 at opposite ends thereof by shaft support bearings 143*a*, 143*b*. Support bearings 143*a*, 143*b* are mounted to vertical stiles 136*a*, 136*b* which reinforce the structural integrity of door 120 generally and hollow door section 130*d* in particular. A pair of spaced-apart cable drums 146*a*, 146*b* are mounted at opposite ends of support shaft 144, and a pair of cables 150*a*, 150*b* are fixed on one end to the drums 146*a*, 146*b*. Spring 142 may be single helical torsion spring or other suitable spring or tensioning device known to those skilled in the art. Spring 142 may be replaced by a pair of springs mounted around support shaft 144similar to the construction of FIG. 2.

A gear reduction device 148 may be used to control tension on spring 142 by permitting one end of spring 142 to rotate at different rates in relation to an opposite end which is fixed onto cone 149 mounted on fixed shaft 144.

The axes of cable drums 146*a*, 146*b* are substantially perpendicular to vertical stiles 136*a*, 136*b* of hollow door section 130*d* of door 120. Cables 150*a*, 150*b* having one end fixed to its respective cable drum 146*a*, 146*b* are wound around each drum and passed around pulleys 160*a*, 160*b* respectively which are pivotally mounted by clevises 141*a*, 141*b* to a bottom rail 139 of door section 130*d* below each cable drum 146*a*, 146*b*, and then to inner races 152*a*, 152*b* respectively of dual race cable drums 147*a*, 147*b* where the opposite ends of cables 150*a*, 150*b* are wound around and fixed to inner races 152*a*, 152*b* of dual race cable drums 147*a* and 147*b* respectively. A second pair of cables 151*a*, 151*b* having one end fixed to and wound about the outer races 153*a*, 153*b* of dual race cable drums 147*a*, 147*b* have the free ends passed around pulleys 170*a* and 170*b* which are mounted for rotation about an axis generally perpendicular to and fixed in the lowermost corners of door section 130*d*. The free ends of cables 151*a*, 151*b* are directed out of section 130*d* of door 120 through apertures 133*a*, 133*b* through cable guides 156*a*, 156*b* and upward to fixed points 180*a*, 180*b* above the doorway. The diameter of the outer races 153*a*, 153*b* may vary relative to the diameters of the inner races 152*a*, 152*b* of each dual race cable drums 147*a*, 147*b* to permit adjustment of tension and to provide a desired mechanical advantage. Dual race cable drums 147*a*, 147*b* are mounted on shafts generally perpendicular to support shaft 144, thereby solving the problem of the maximum permissible size of cable drums 146*a*, 146*b* which are fixed by the thickness of door section 130*d* with a panel cover in place,such as shown as 31 in FIG. 1. Theoretically the size of dual race cable drums 147*a*, 147*b* is limited only by the height of door panel 130*d*. It will be recognized that gear reduction device 148 can deliver motion from tensioning of spring 142 directly to cable drums 147*a*, 147*b* giving a user the option of sizing the drum and delivering the winding force around a perpendicular axis. A workable ratio of diameters of outer races 153*a*, 153*b* to inner races 152*a*, 152*b* is 4:1, although any ratio of outer race (153*a*, 153*b*) diameter to inner race (152*a*, 152*b*) diameter including using spiraling diameters to provide a desired mechanical advantage can be used. Cables 150*a*, 150*b* and 151*a*, 151*b* may replaced by, for example, cords, ropes, belts, chains, and the like. Although cable guides 156*a*. 156*b* can be u-bolts, other cable guide means such as cable snubs or idler pulleys can be used. A motor m, incorporated into the door section 130*d*, may be coupled to support shaft 144 to achieve remote controlled operation of the door 120.

Figure 4:
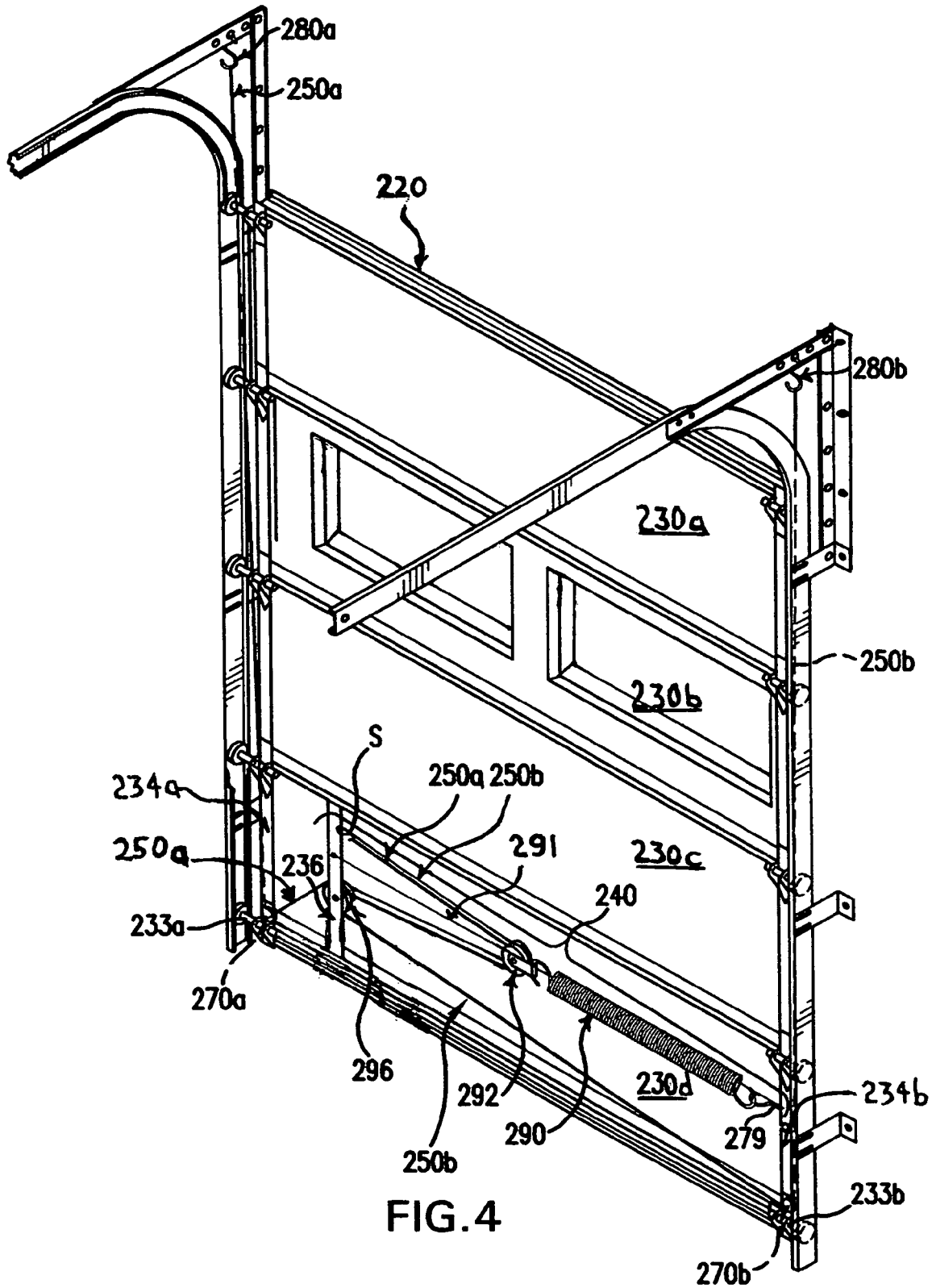
FIG. 4 is a rear perspective view of an overhead door assembly according to the invention with the door in a closed position showing an alternate fixed spring counterbalance assembly according to the present invention.

As shown in FIG. 4, counterbalance mechanism 240 of door 220 includes a generally horizontally disposed extension spring 290 contained within door section 230*d* and attached at one end to a fixed location therein via means 279. Spring attachment means 279, is shown in FIG. 4 as a hook, but other conventional attachment means can be used. A dual pulley 292 is attached by a conventional means to the free end of extension spring 290 is positioned by and supported by cables 250*a*, 250*b* as described below. Cables 250*a*, 250*b* having one end fixed at a point along the length of vertical stile 236 using an S shaped-hook or other suitable means extend partially around dual pulley 292. The free end of cable 250*a* is passed around pulley 296, which is mounted for rotation at a fixed point along the length of vertical stile 236, and then through bottom pulley fixture 270*a*, out of door section 230*d* via aperture 233*a* in vertical side stile 234*a*, and then upward to fixed point 280*a* above door 220. In like fashion, the free end of cable 250*b* passes around dual pulley 292 and then around pulley 296, and thereafter through bottom pulley fixture 270*b*, out of door section 230*d* through aperture 233*b* in vertical side stile 234*b*, and then upward to fixed point 280*b* above the door 220. The common paths of cables 250*a*, 250*b* from point S around dual-pulley 292 permits extension of spring 290 to exert equal tension in each of cables 250*a*, 250*b*. The vertical run of cables 250*a* and 250*b* exiting door section 230*d* are kept plumb and adjacent to the outer edges of door 230 by position and control spring 290. The linear extension of spring 290 and movement of cables 250*a*, 250*b* may be controlled by the addition of motor drive (i.e. screw or chain drive) inside of the door section 230*d* itself. Although spring 290 is described as a single spring, any number of extension springs may be combined in tandem or side by side. Other arrangements including use of springs of different diameters, one inside the other are within the scope of the present invention. A safe practice would be to run a taut stationary cable, bar or the like 291 through extension spring 290 with cable 291 extended parallel to a central axis of spring 290 from stile 236 to stile 234*b* the event of spring or cable breakage. A sleeve could also be placed around all or portions of extension spring 290 to form a compartment to contain the spring in the event of breakage. Such a sleeve would be fixed to the outer panel of door section 230*d*. Alternatively a shelf or other support fixed to door section 230*d* could be placed beneath spring 290.

Figure 5:
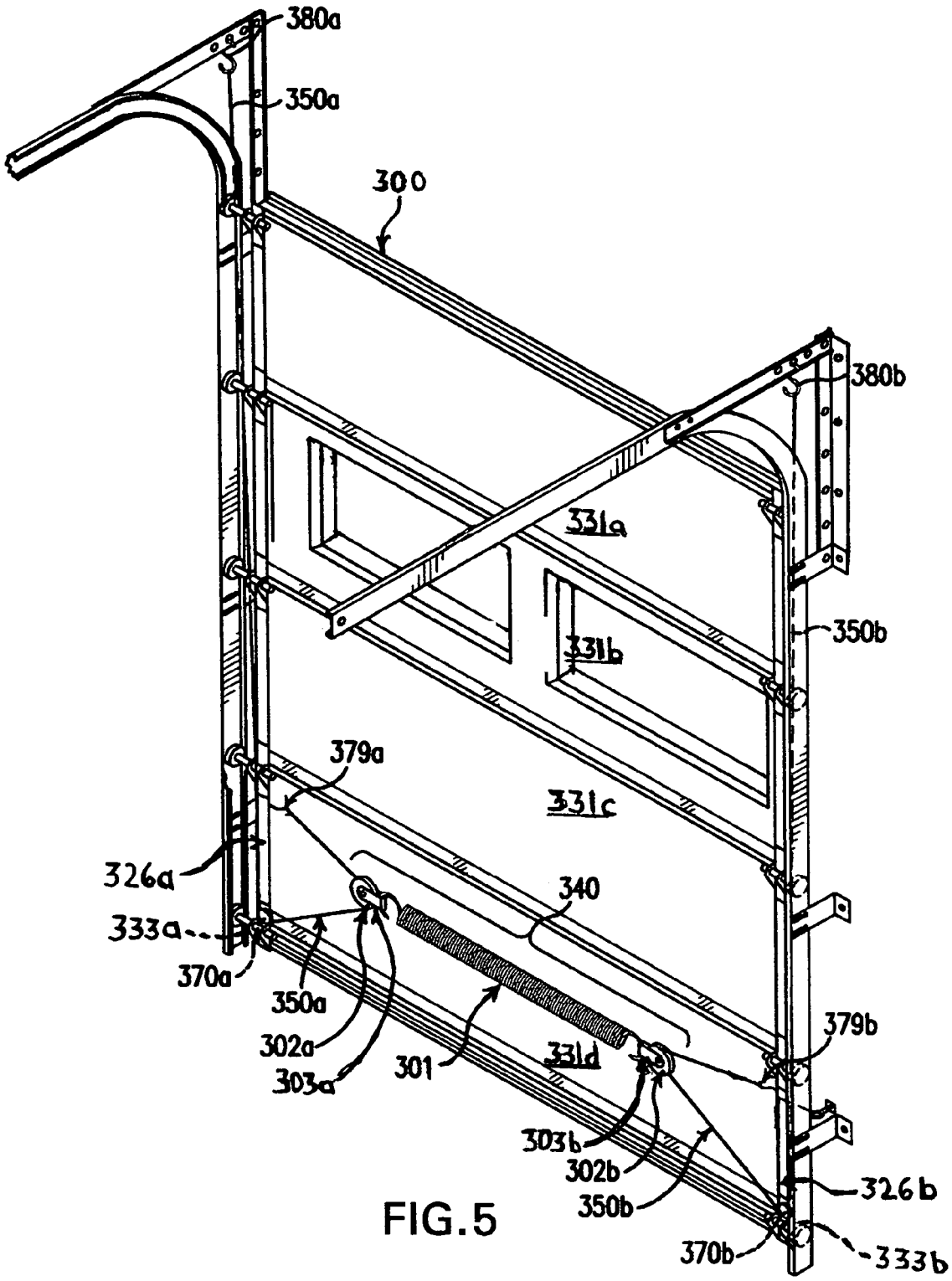
FIG. 5 is a rear perspective view of an overhead door and counterbalance assembly according to the present invention utilizing a freely suspended spring counterbalance assembly.

As shown in FIG. 5, another counterbalance mechanism 340 disposed in generally horizontal position within section 331*d* of door 300. Horizontally disposed extension spring 301 with pulleys 302*a*, 302*b* attached at either end is free-floating and suspended within hollow door section 331*d* by means of cables 350*a* and 350*b*. Pulleys 302*a*, 302*b* are shown as attached to a hook shaped portion formed in the opposite ends of extension spring 301 by means of a clevis (eg. 303*a*, 303*b*) and positioned by means of cables 350*a* and 350*b*. Attachment of pulleys 302*a* and 302*b* may take other forms as would be apparent to a worker skilled in the art. Cables 350*a*, 350*b* are fixed respectively to side door stiles 326*a* and 326*b* of door section 331*d* at locations 379*a*, 379*b* using an S-hook or other suitable means. Cables 350*a*, 350*b* can alternatively be anchored to vertical stiles adjacent to stiles 326*a* and 326*b* or any other suitable points within hollow door section 331*d*. Cables 350*a*, 350*b* are passed around pulleys 302*a*, 302*b* respectively and thereafter through bottom pulley fixtures 370*a*, 370*b* respectively and, out of the hollow door section 331*d* through suitable apertures (333*a*, 333*b*) in vertical stiles 326*a* and 326*b* of section 331*d* of door 300 to fixed points 380*a*, 380*b* above door 300. As shown in FIG. 5 the free ends of cables 350*a* and 350*b* are fixed to a bracket fixed to each of the door tracks by S shaped hooks. The cables 350*a*, 350*b* can also be fastened to the door frame or the building structure surrounding the door frame or door opening. A safety bar or cable such as illustrated in relation to the embodiment of FIG. 4 can be used to control movement of the spring 301 in the event one or more of cables 350*a*, 350*b* breaks or becomes slack or spring 301 breaks.

Figure 6:
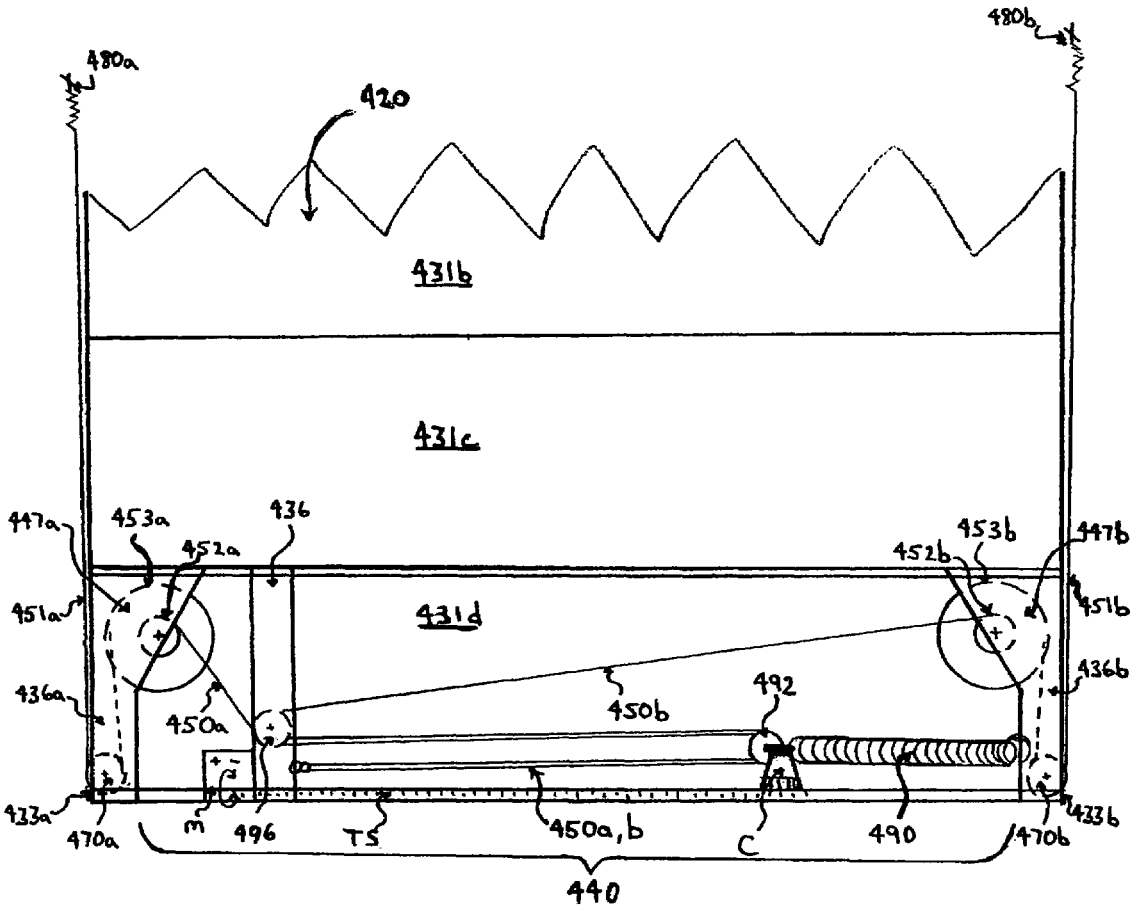
FIG. 6 is a fragmentary rear elevational view of an alternate overhead door and counterbalance assembly according to the invention.

It may be readily appreciated that the counterbalance mechanism 240 (FIG. 4) may be further enhanced by combining the advantage gained by counterbalance mechanism 140 (FIG. 3) through the use of dual race cable drums. As shown in FIG. 6, an alternate counterbalance mechanism 440 is provided for controlling movement of door 420 as it moves between the open and closed positions or vice versa. Counterbalance mechanism 440 consists of a relatively horizontal extension spring 490 having one end attached by conventional means to a fixed location on end stile 436*b*. Stile 436*b* is fabricated to position spring 490 and to position dual race cable drum 447*b*. One end of cables 450*a*, 450*b* are fixed to vertical stile 436 by conventional means and then passed around dual pulley 492 and back to dual pulley 496 mounted at a second location on vertical stile 436. The free ends of cables 450*a*, 450*b* are then directed respectively to inner races 452*a*, 452*b* of dual race cable drums 447*a*, 447*b*. Cables 450*a*, 450*b* are wound around and fixed to their respective inner races (452*a*, 452*b*). A second pair of cables 451*a*, 451*b* are fixed to and wound about the outer races 453*a*, 453*b* of dual race cable drums 447*a*, 447*b* and run to the lowermost corners of door section 431*d* where they pass through bottom pulley fixtures 470*a*, 470*b* and are then directed out of door 420 through apertures 433*a*, 433*b* and upward to fixed points 480*a*, 480*b* above the door 420. The energy delivered to inner races 452*a*, 452*b* will be transferred to outer races 453*a*, 453*b* and a mechanical advantage will be gained in order to allow the extension of spring 490 to effect balance of door 420 from the full open to the full closed position. Spring sizing and the ratio of inner races to outer races of the dual race cable drums may vary and can be selected for optimal mechanical advantage by those skilled in the art. FIG. 6 includes the addition of motor drive M which rotates threaded shaft TS which runs parallel to spring 490. The rotation of shaft TS causes carriage C to traverse shaft TS by means of a nut engaging shaft TS. Carriage C is connected to extension spring 490 and the movement will cause the extension or retraction of spring 490, thereby enabling remote opening and closing of door 420. The apparatus of FIG. 6 is ideally suited for use in a large overhead door such as found in automotive repair shops where the door itself must move in a substantially vertical plane prior to the door sections changing direction for horizontal storage in the open position.

Figure 7:
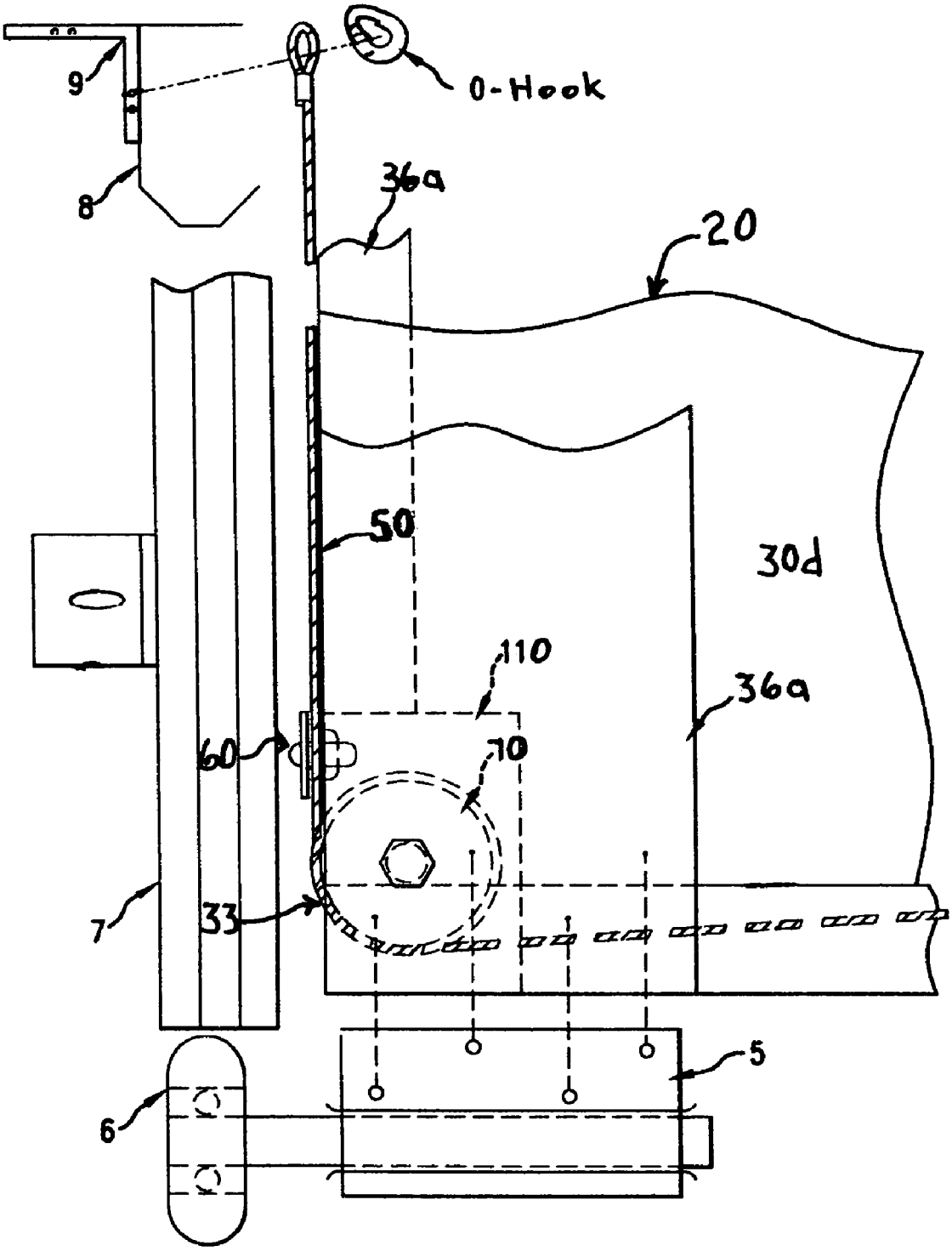
FIG. 7 is an enlarged fragmentary view of a bottom pulley assembly according to the present invention.

FIG. 7, is an enlarged fragmentary view of one type bottom pulley fixture 110 which can be fixed to a lower corner of door section 30*d*, (and also 130*d*, 230*d*, 331*d* or 431*d*) in a manner so that pulley 70 of fixture 110 projects slightly outside of the vertical side stile 36*a* of door section 30*d*. Cable 50 passes around pulley 70 and out of aperture 33 of stile 36*a* to a fixed point 80 and attached by conventional means. A cable snub 60 may guide cable 50 to provide a vertical and generally plumb orientation of cable 50 from the bottom of door 20 to the fixed point 80 above the door opening. Although bottom pulley fixture 110 is in the form of an independent part it may formed as an integral part of the end stile 36*a* during construction of door section 30*d*. Roller carrier 5, stemmed roller 6, vertical track 7, horizontal truck 8, and horizontal angle 9 are shown for orientation to door 20.

Figure 8:
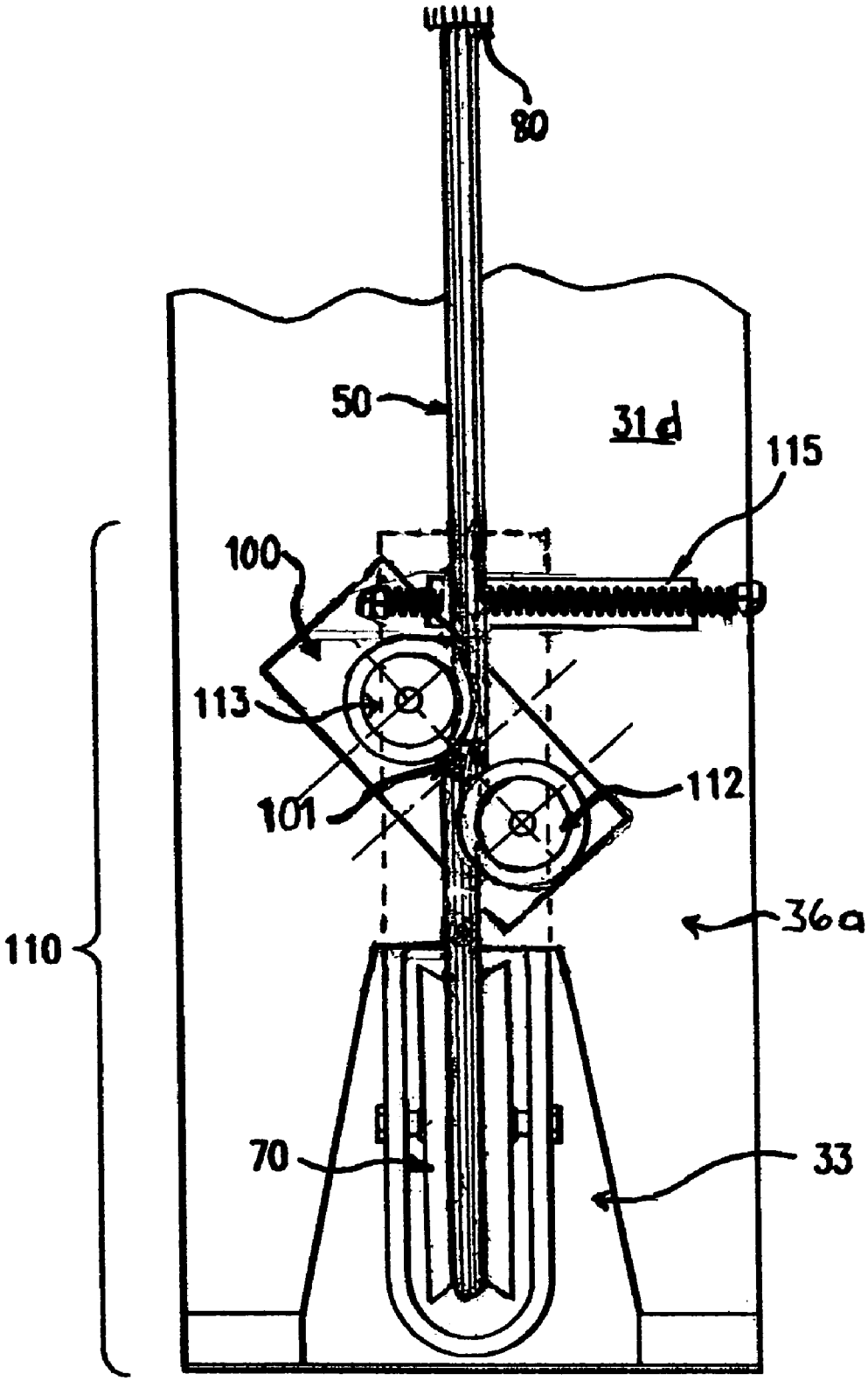
FIG. 8 shows an alternate embodiment of the bottom pulley assembly according to the present invention.

FIG. 8, is an enlarged section of a mechanism for use with the device of FIG. 7 to maintain vertical orientation of cable 50 as it passes out of hollow door section 31*d* through aperture 33. As with the device of FIG. 7 cable 50 passes around pulley 70 out of aperture 33 to fixed point 80. Idler cam 100 is mounted for rotation about a center point 101 fixed on an outside face of stile 36*a* with control spring 115 to bias pivoting of the idler cam 100 about point 101 to maintain cable 50 and in a vertical orientation between pulley 70 and point 80. Cable 50 passes between pulley 112 and pulley 113 on idler cam 100 and thereafter to fixed point 80. Movement of idler cam 100 is controlled by spring mechanism 115 to maintain the vertical orientation of cable 50.

The present invention enables a user to use conventional steel roll formed door sections with a thickness ranging from 2 inches to 6 inches by modifying them to accept a counterbalance mechanism according to the invention without substantial retooling of manufacturing equipment. Further, the counterbalance mechanism of the invention may be utilized with door sections of greater or lesser thickness through modification of the door and back cover panel using reinforcing members and associated hardware.

The present invention provides a counterbalance mechanism for overhead doors using a single extension spring enclosed in a section of a door wherein the spring is suspended between the cables, the spring and cable assembly permitting control of the movement of the door during opening and closing of the door.

The present invention provides a counterbalance mechanism for an overhead door using one or more extension springs positioned in an enclosed portion of the body of an overhead door section, the springs and cable assembly permitting control of the movement of the door during opening and closing of the door manually or with the addition of a drive motor.

The present invention provides a counterbalance mechanism within an enclosed portion an overhead door using a torsion spring assembly inside the body of the door, or a section of the body of the door, the torsion spring assembly acting as the counterbalancing mechanism of the overhead door to control movement of the door during opening and closing of the door.

The present invention provides a counterbalance mechanism for overhead (vertically moveable) doors, using a torsion spring assembly whereby force may be applied to or relieved from a torsion spring assembly by a gear reduction device, the entire mechanism disposed within a hollow door section, the assembly acting to control movement of the door during opening and closing of the door with or without the addition of a rotary drive motor.

Although this invention has been disclosed in the context of certain embodiments and examples, it will be understood by those skilled in the art that the present invention extends beyond the specifically disclosed embodiments and/or uses of the invention and that the scope of the present invention herein disclosed should be limited only by a fair reading of the appended claims.

What is claimed:

1. In a multi-panel garage door wherein each panel has opposite vertical edges reinforced by a vertical stile, said garage door movable from one of a generally vertical closed position to one of a generally vertical or horizontal open position and returnable to an original position the improvement comprising:

a counterbalance mechanism contained completely within a bottom most panel of the multi-panel door, the counterbalance mechanism enabling the door to be more easily moved and maintained in any position from fully open to fully closed or in between fully open and fully closed, the counterbalance mechanism fully contained between opposite vertical stiles and inside of said bottom most panel utilizing cables, each cable having one end connected to an opposite end of the counterbalance mechanism and the other end of each of said cables exiting said panel and attached to one of means supporting the door or the structure surrounding the door.

2. A garage door according to claim 1 wherein the counterbalance mechanism is incorporated into a generally closed compartment formed in the door.

3. A garage door according to claim 2 wherein the compartment is formed using one panel of a multiple panel door covered by a removable cover panel, the panel and cover panel defining a hollow cavity to receive the counterbalance mechanisms.

4. A garage door according to claim 1 wherein the counterbalancing mechanism includes a torsion spring to control winding and unwinding of the cables.

5. A garage door according to claim 4 wherein the counterbalance mechanism includes dual race cable drums and dual cables to effect control of movement of the garage door.

6. A garage door according to claim 1 wherein the counterbalancing mechanism includes an extension spring connected to the cables to control movement of the garage door.

7. A garage door according to claim 6 wherein the counterbalance mechanism includes dual race cable drums and dual cables to effect control of movement of the garage door.

8. A garage door according to claim 1 wherein said counterbalance mechanism is motor actuated.

9. A garage door according to claim 1 wherein the cables extend from the counterbalance mechanism out of a lowermost location on either side of said door via transfer pulleys to said means supporting the door or the structure surrounding the door, said transfer pulleys mounted in opposite edge stiles of said panel containing said counterbalance mechanism.

10. A multi-panel overhead garage door wherein each panel has opposite vertical edges reinforced by a vertical stile, said door positioned in fixed tracks disposed on either side of the door, the door having at least one hollow door section proximate a bottom edge of the door, the hollow door section containing a counterbalance mechanism, completely therein the counterbalance mechanism including an extension spring having a first and a second end with a first end of said extension spring fixed to one of said stiles, said second end of said extension spring fixed to a multi-race pulley, a pair of cables fixed to said panel at a location opposite to said fixed end of said extension spring, each of said cables extending around one race of said dual race pulley attached to said extension spring and around a race of a second dual race idler pulley mounted at a location spaced apart from the location where said cables are fixed to said panel, the free end of each of said cables extending from said idler pulley out of the door panel to fixed points above and adjacent either side of the door.

11. A garage door according to claim 10 wherein the counterbalance mechanism includes means to support said extension spring in a generally horizontal position in the event a cable or said extension spring fails.

12. A garage door according to claim 10 wherein the counterbalance mechanism includes a support stile intermediate said end stile to fasten said fixed end of said cables and to position said cables and said idler pulley.

13. A vertically moveable multi-section door having at least one hollow door section containing a counterbalance mechanism completely therein, the counterbalance mechanism having a torsion spring means, cable drums fixed to each end of the torsion spring means, a cable spooled around each drum, and a plurality of direction transfer pulleys, each cable passing around a direction transfer pulley out of an opposite side of the hollow door section to a fixed point above the door.

14. A multi-panel overhead door wherein each panel has opposite vertical ends reinforced by vertical stiles, said door of the type positioned in fixed tracks disposed on either side of the door, the improvement comprising, the door having at least one hollow door section completely containing a counterbalance mechanism contained between opposite vertical stiles of said hollow door section therein, the counterbalance mechanism including an extension spring means, at least two pulleys each of the pulleys fixed to an opposite end of the extension spring, at least two cables with one end of each cable attached to fixed points within the hollow door panel and running through a pulley on each end of said extension spring and exiting opposite sides of the hollow door section to fixed points above and adjacent to either side of the door.

* * * * *